US006580435B1

(12) United States Patent
Lippincott

(10) Patent No.: US 6,580,435 B1
(45) Date of Patent: Jun. 17, 2003

(54) OVERLAY EARLY SCAN LINE WATERMARK ACCESS MECHANISM

(75) Inventor: Louis A. Lippincott, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 435 days.

(21) Appl. No.: 09/605,773

(22) Filed: Jun. 28, 2000

(51) Int. Cl.[7] ..... G09G 5/00

(52) U.S. Cl. ..... 345/629; 345/543; 345/544; 345/558; 345/560; 345/631

(58) Field of Search ..... 345/543, 544, 345/558, 560, 631, 629

(56) References Cited

U.S. PATENT DOCUMENTS 5,392,396 A * 2/1995 MacInnis ..... 345/543
5,598,525 A * 1/1997 Nally et al. ..... 345/546
5,754,170 A * 5/1998 Ranganathan ..... 345/558
5,953,020 A * 9/1999 Wang et al. ..... 345/558
6,044,419 A * 3/2000 Hayek et al. ..... 710/57
6,108,014 A * 8/2000 Dye ..... 345/544
6,339,427 B1 * 1/2002 Laksono et al. ..... 345/553

* cited by examiner

*Primary Examiner*—Matthew C. Bella
*Assistant Examiner*—Mike Rahmjoo
(74) *Attorney, Agent, or Firm*—Blakely, Sokoloff, Taylor & Zafman LLP

(57) ABSTRACT

An overlay video processing system provides an early start to pixel processing for the next overlay scan line. The overlay processor begins processing the next overlay scan line while still displaying the current scan line. A FIFO buffer is used to provide the overlay video data to the display. When it is determined that the buffer is capable of storing the next overlay scan line, a memory read burst is triggered, and the buffer begins to load the data for the next overlay scan line.

22 Claims, 6 Drawing Sheets

OVERLAY EARLY SCAN LINE WATERMARK ACCESS MECHANISM

BACKGROUND OF THE INVENTION

1. Field of the Invention

This invention relates to computer display systems, and more particularly to processing overlay scan lines in computer display systems.

2. Background Information

Conventional computer systems generate pixel maps to represent graphics images. A pixel map is a two dimensional array of pixel values where each pixel value indicates information including color for a corresponding pixel on a monitor or other video display.

Video overlay is the placement of a full-motion video window on the display screen. Video overlay systems can insert a video image, such as might be generated by a television tuner, a video camera, VCR, or a video decoder, into a graphics image. Video overlay systems commonly include software that generates a pixel map, representing the graphics image and provides a video window that is filled with a color key, in the graphics image. A separate device such as a video capture card generates the video image.

Current video overlay systems use the horizontal blank time start as an indicator to start processing pixels for the next overlay scan line. This technique was sufficient with lower resolution monitors that have long horizontal blank times. Higher resolution monitors and flat panel displays, however, have significantly reduced the amount of horizontal blank time. Therefore, higher memory bandwidth is needed to ensure the pixel processing is completed in sufficient time to display the next overlay scan line.

DETAILED DESCRIPTION

The invention generally relates to a method and apparatus for processing pixels for display. One embodiment applies a unique burst length trigger detection scheme to an overlay pixel processing engine. Referring to the figures, exemplary embodiments of the invention will now be described. The exemplary embodiments are provided to illustrate the invention and should not be construed as limiting the scope of the invention.

Figure 1:
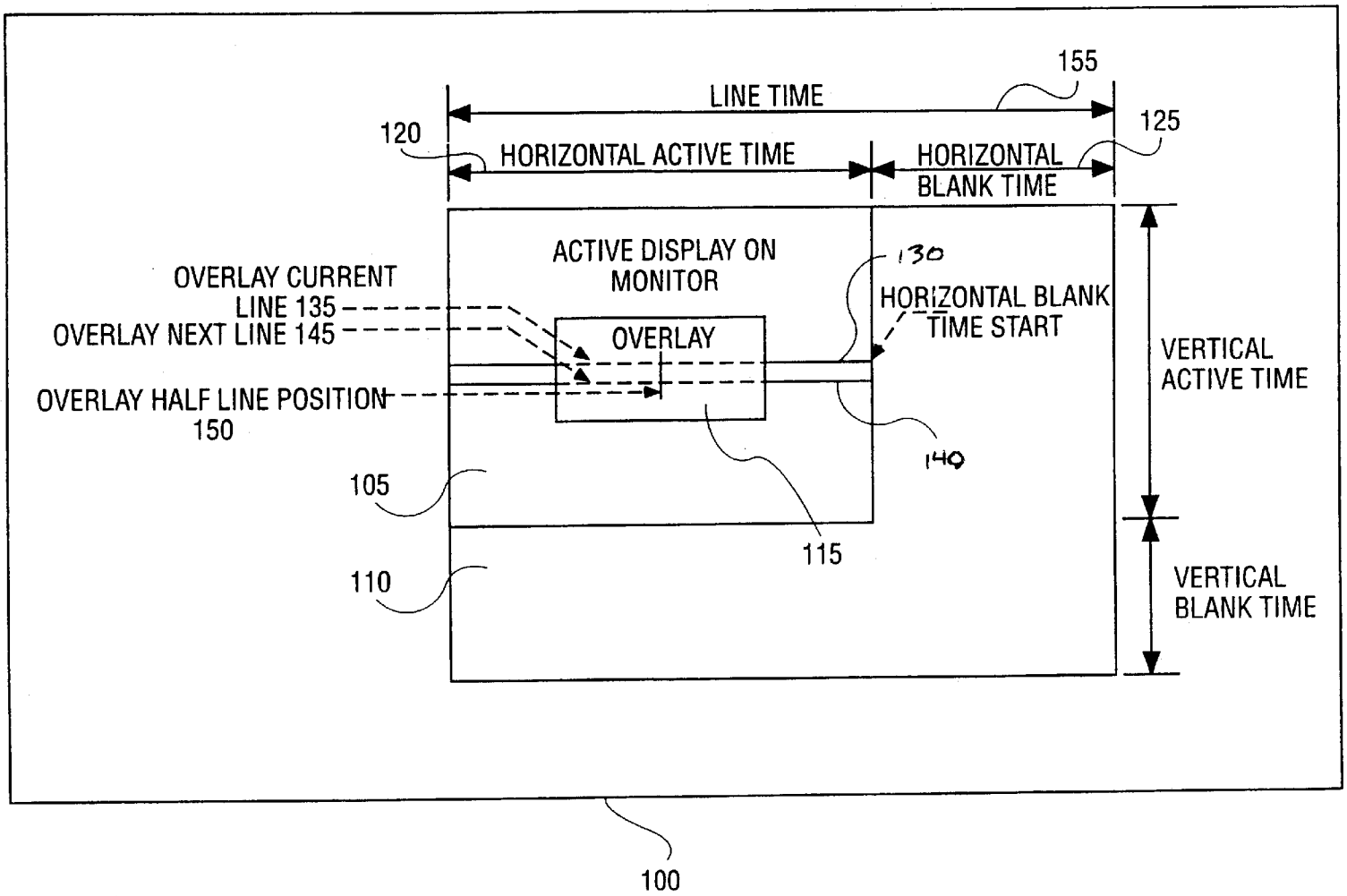
FIG. 1 illustrates a computer display including an overlay.

FIG. 1 illustrates computer display 100 including overlay window 115. Computer display 100 includes overall display 110, active display 105, overlay window 115, horizontal active time 120, horizontal blank time 125, first display line 130, current overlay display line 135, second display line 140, next overlay display line 145, and overlay display position indicator 150. Active display 105 represents the portion of computer display 100 visible to the user. Overlay window 115 places full-motion video on the display screen. Overlay window 115 may display, for example, video from a DVD-ROM drive. Overlay window 115 may be positioned at any point in active display 105.

Overlay window 115 is generated by processing and displaying consecutive overlay display lines. The combination of a plurality of these overlay display lines creates the overlay display window. For simplification purposes, the operation of overlay display window 115 is described showing current overlay display line 135 and next overlay display line 145.

The processing of overall display 110 is divided into multiple sections, including horizontal active time 120 and horizontal blank time 125. Horizontal active time 120 represents the time during which active display 105 is processed. Active display 105 processes first line 130 during horizontal active time 120. When an overlay display window is active, current overlay display line 135 is processed during horizontal active time 120. After first display line 130 is processed, overall display 110 waits for a period of time, i.e., horizontal blank time 125, before processing second display line 140. Previous display systems also waited until the end of horizontal active time 120 before processing next overlay display line 145. With more advanced and higher resolution displays, horizontal blank time 125 is significantly reduced. Thus, higher memory bandwidth is needed to ensure the pixel processing is completed in sufficient time to display next overlay scan line 145.

Figure 2:
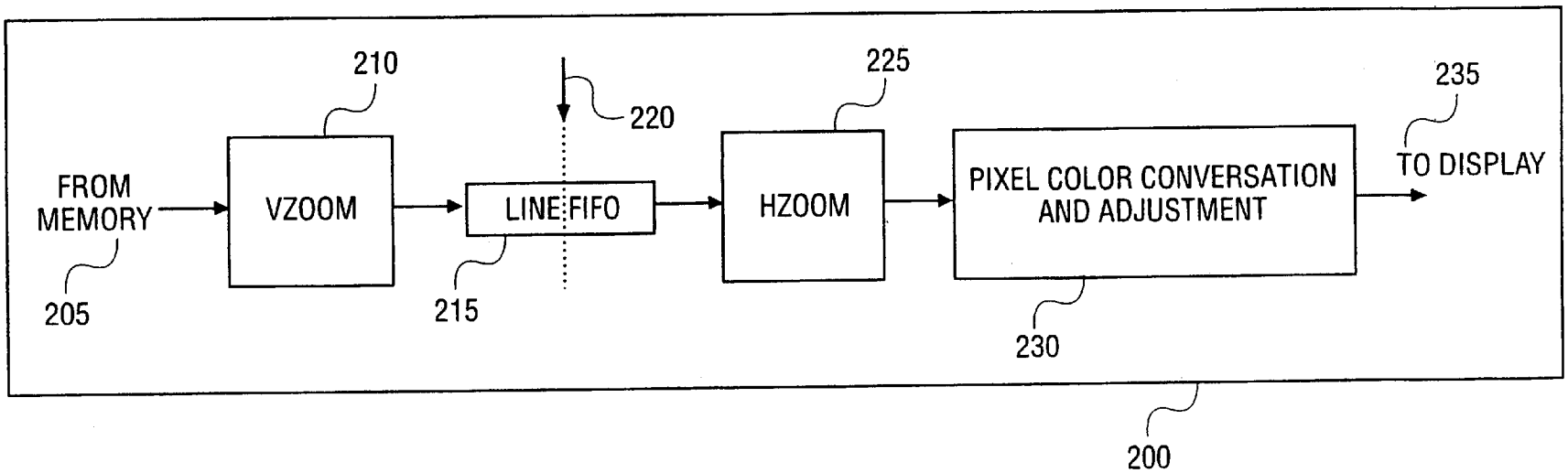
FIG. 2 illustrates a pixel processing engine.

To allow additional time to process next overlay scan line 145 and therefore reduce the need to have increased memory bandwidth, the embodiment illustrated in FIG. 2 uses the overlay display position indicator 150. Overlay display position indicator 150 may be located at any location along current overlay scan line 135. In the shown in FIG. 2, overlay display position indicator 150 is located at approximately the midpoint of current overlay scan line 135. Locating overlay display position indicator 150 at the midpoint of current overlay scan line 135 allows the video line buffer providing data for overlay window 115 to be approximately half-empty before beginning the processing for next overlay scan line 145. By beginning the processing for next overlay scan line 145 at the midpoint of displaying current overlay scan line 135, next overlay scan line 145 is processed during horizontal active time 120. Of course, when current overlay scan line 135 is fully displayed, the buffer can begin processing the final portion of next overlay scan line 145.

Pixel processing engine 200 includes an input from video memory 205, vertical zoom ($V_{zoom}$) 210, video line buffer 215 having position indicator 220, horizontal zoom ($H_{zoom}$) 225, pixel color conversion and adjustment stage 230, and output 235 to the display. Pixel processing engine 200 generates the pixel information necessary to display overlay window 115. Pixel processing engine 200 creates overlay window 115 by generating a plurality of overlay scan lines.

Pixel processing engine 200 receives video data at an input from video memory 205. The video data is processed by $V_{zoom}$ 210. $V_{zoom}$ 210 is a vertical filter that processes the video data to provide any adjustments in the vertical direction. After processing by $V_{zoom}$ 210, the video data is sent to video line buffer 215. In one embodiment, video line buffer 215 is a first-in, first-out (FIFO) buffer. Video line buffer 215 may include position indicator 220 showing the buffer location of the last item of data processed. Video line buffer 215 provides storage for the video data until the video data is sent to the display.

After leaving video line buffer 215, the video data is processed by $H_{zoom}$ 225. $H_{zoom}$ 225 is a horizontal filter that processes the video to provide any adjustments in the horizontal direction. After processing by $H_{zoom}$ 225, the video data is sent to pixel color conversion and adjustment stage 230 for further processing. Pixel color conversion and adjustment stage 230 performs the final processing and adjustment to the video data before being sent to the display. The details of the processing are known to one of skill in the art and will not be discussed herein. After final processing the video data is provided to output 235 for transmission to the display.

Figure 3:
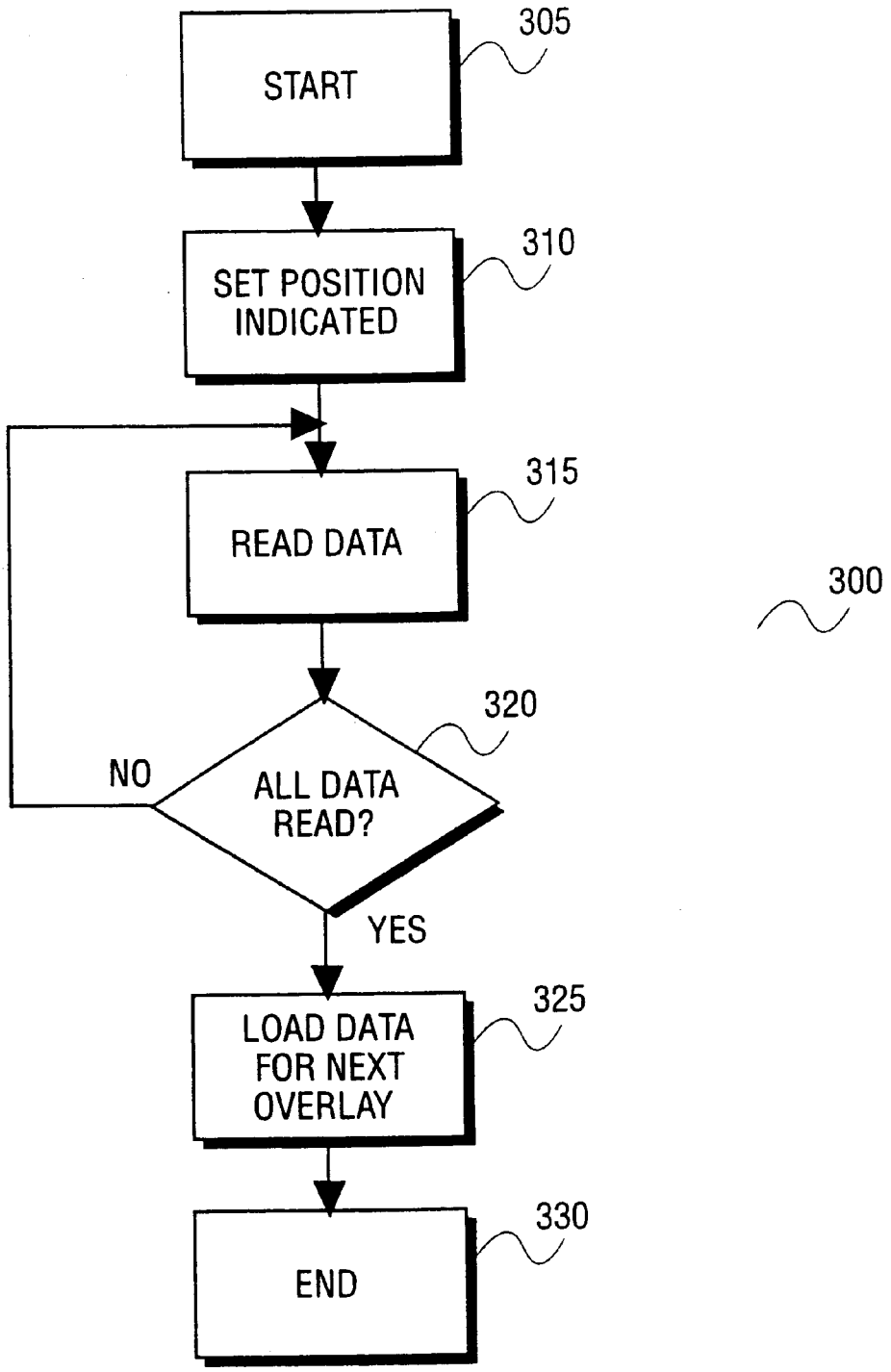
FIG. 3 is a flowchart showing an overlay data loading process used by the pixel processing engine illustrated in FIG. 2.

FIG. 3 shows the overlay data loading process 300 used by pixel processing engine 200 in FIG. 2. Process 300 begins at start state 305. Proceeding to state 310, process 300 sets position indicator 220 at a predetermined location in video line buffer 215. In one embodiment, position indicator 220 is set at approximately the midpoint of video line buffer 215. Of course, position indicator 220 may be set at any point in the buffer.

Proceeding to state 315, the overlay pixel data is read from video line buffer 215 and provided to the display. The overlay pixel data is used to build current overlay data line 135 in overlay window 115. With each bit of pixel data read, the memory location to read from video line buffer 215 is incremented.

Proceeding to state 320, process 300 determines if the last pixel data was retrieved from the buffer at the indicator location. For example, if the indicator is at the midpoint of the buffer, current overlay data line 135 in overlay window 115 will be half-drawn when the buffer memory location reaches the indicator. If the buffer has not reached the indicator, process 300 proceeds along the NO branch back to state 315. Instate 315, process 300 continues to read data from the buffer to draw current overlay data line 135. Process 300 remains in this loop until current overlay data line 135 is drawn to a point where the indicator is reached.

Returning to block 320, if the video line buffer has reached the indicator, process 300 proceeds along the YES branch to state 325. In state 325, pixel processing engine 200 begins to read data from the video memory for next overlay data line 140. This loads the video line buffer with data for next overlay data line 145 prior to the completion of drawing of the current overlay data line 135. After the pixel processing engine begins loading data for next overlay data line 145, process 300 terminates in end state 330.

Figure 4:
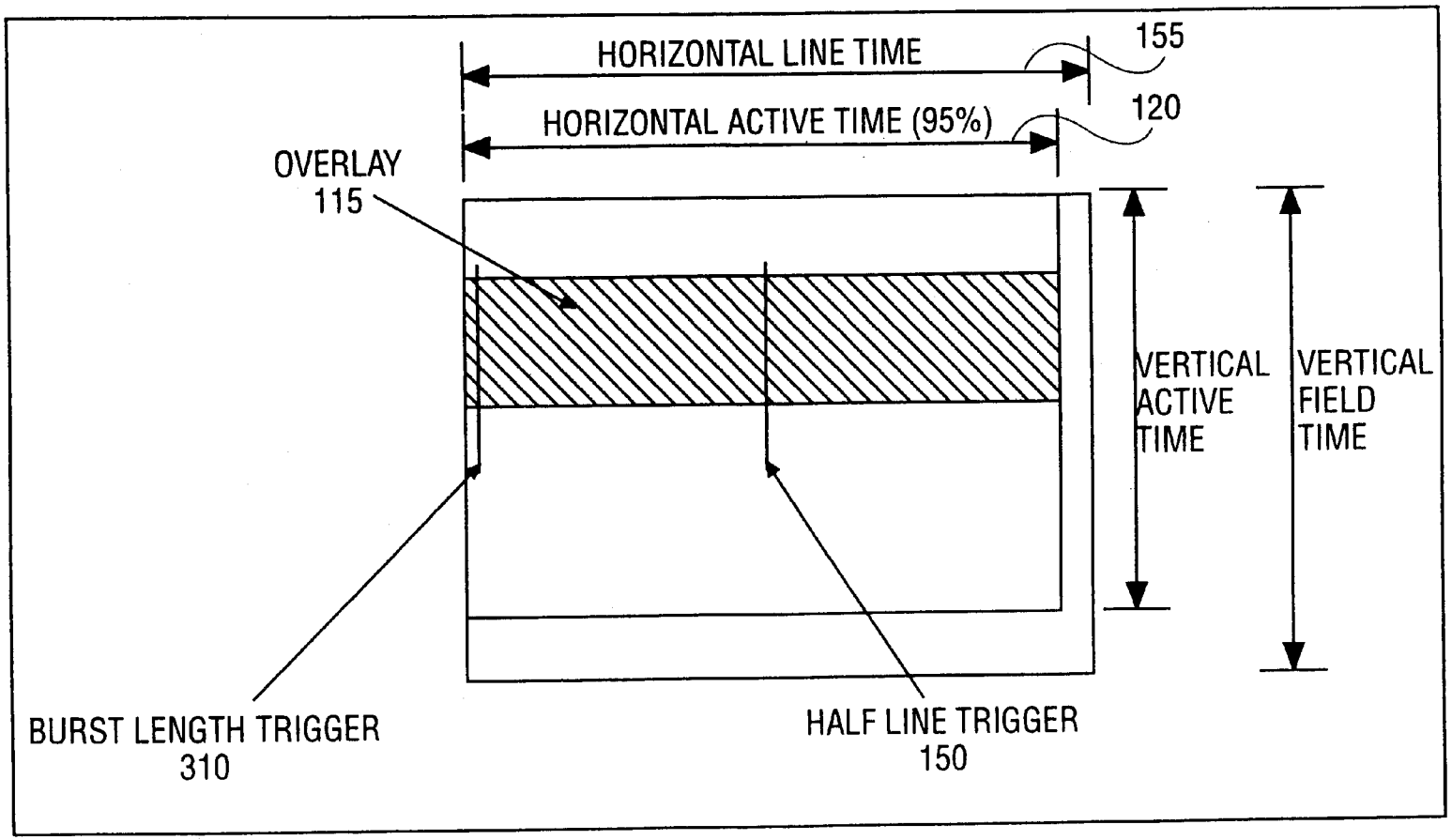
FIG. 4 illustrates a computer display including an overlay window showing a burst length trigger according to one embodiment of the present invention.

While the above mentioned embodiments are an improvement over the horizontal blank start method, they too have a shortcoming in that they wait until the overlay has progressed through a portion, namely one half, of its video line buffer 215 before starting the fetch for the next scan line. In fact, there is a considerable amount of delay in certain overlay situations. As can be seen in FIG. 4, about 45% of the available time is wasted when the video overlay occupies the full width of the screen. Therefore, if the video overlay occupies the entire width of the display, about 45% of horizontal time 155 will be unused for pre-fetching the next line of video overlay data.

In an embodiment of the present invention, because of considerable wasted time, as disclosed above, when burst length trigger 310 is used to start the pre-fetch for the next line of video overlay data, almost all of horizontal time 155 is used.

Figure 5:
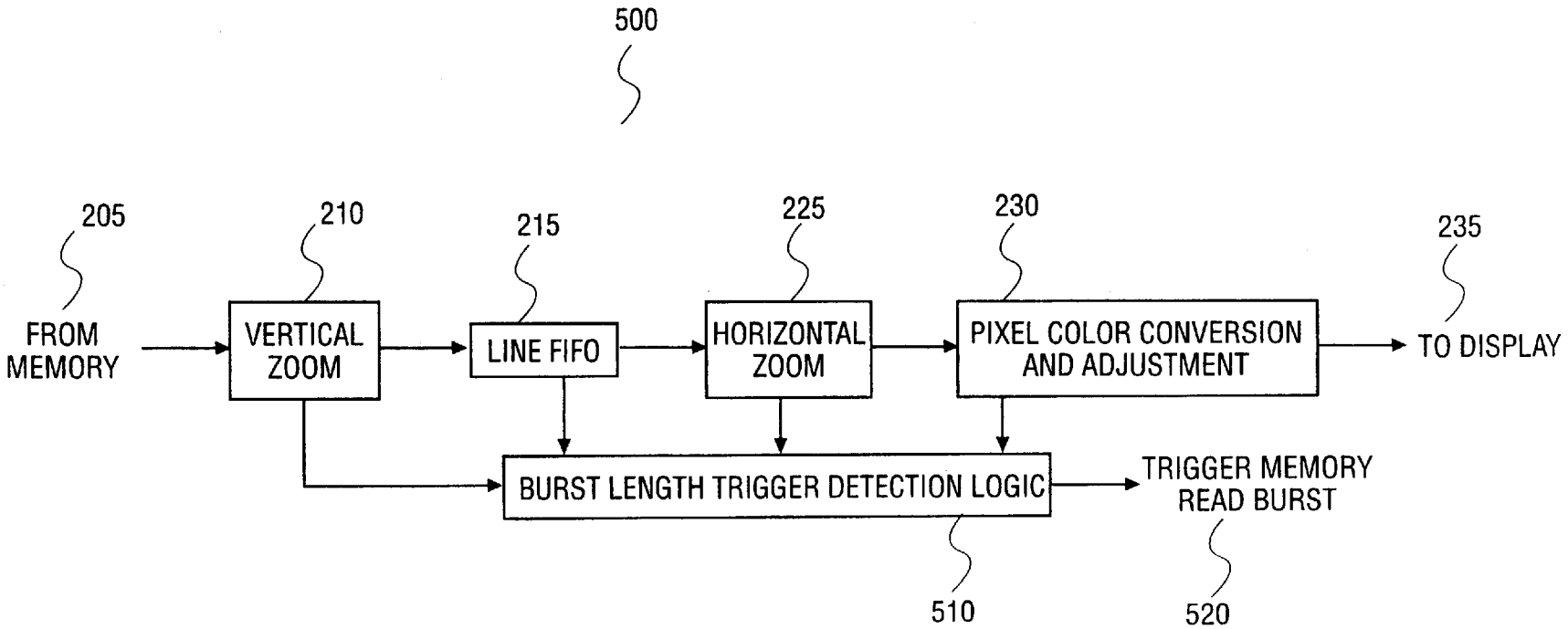
FIG. 5 illustrates a pixel processing engine having a burst length trigger detection logic according to one embodiment of the present invention.

FIG. 5 illustrates an improvement on the pixel processing engine 200. Pixel processing engine 500 adds burst length trigger detection logic 510. Burst length trigger detection logic 510 adds a block of logic to the overlay logic to test video line buffer 215 to determine when a new memory read of the next scan lines data can be executed. Logic 510 triggers the next burst read when it is determined that video line buffer 215 is able to store the amount of data to be returned by the burst read of memory. An advantage of this embodiment is that video line buffer 215 is kept as full as the memory read latency and bandwidth allows.

Logic 510 ensures a maximum utilization of video line buffer 215 and memory bandwidth. Without logic 510 ensuring enough storage space is available in video line buffer 215 to accept the burst length of data from memory 205, the burst could be terminated prematurely which would waste memory bandwidth.

Burst length trigger detection logic 510 also considers the amount of space in the logic blocks following video line buffer 215, namely $H_{zoom}$ 225 and pixel color conversion 230, and the type of processing that these blocks are performing, such as scaling ratio, sub-sampling, up-sampling, etc.

Figure 6:
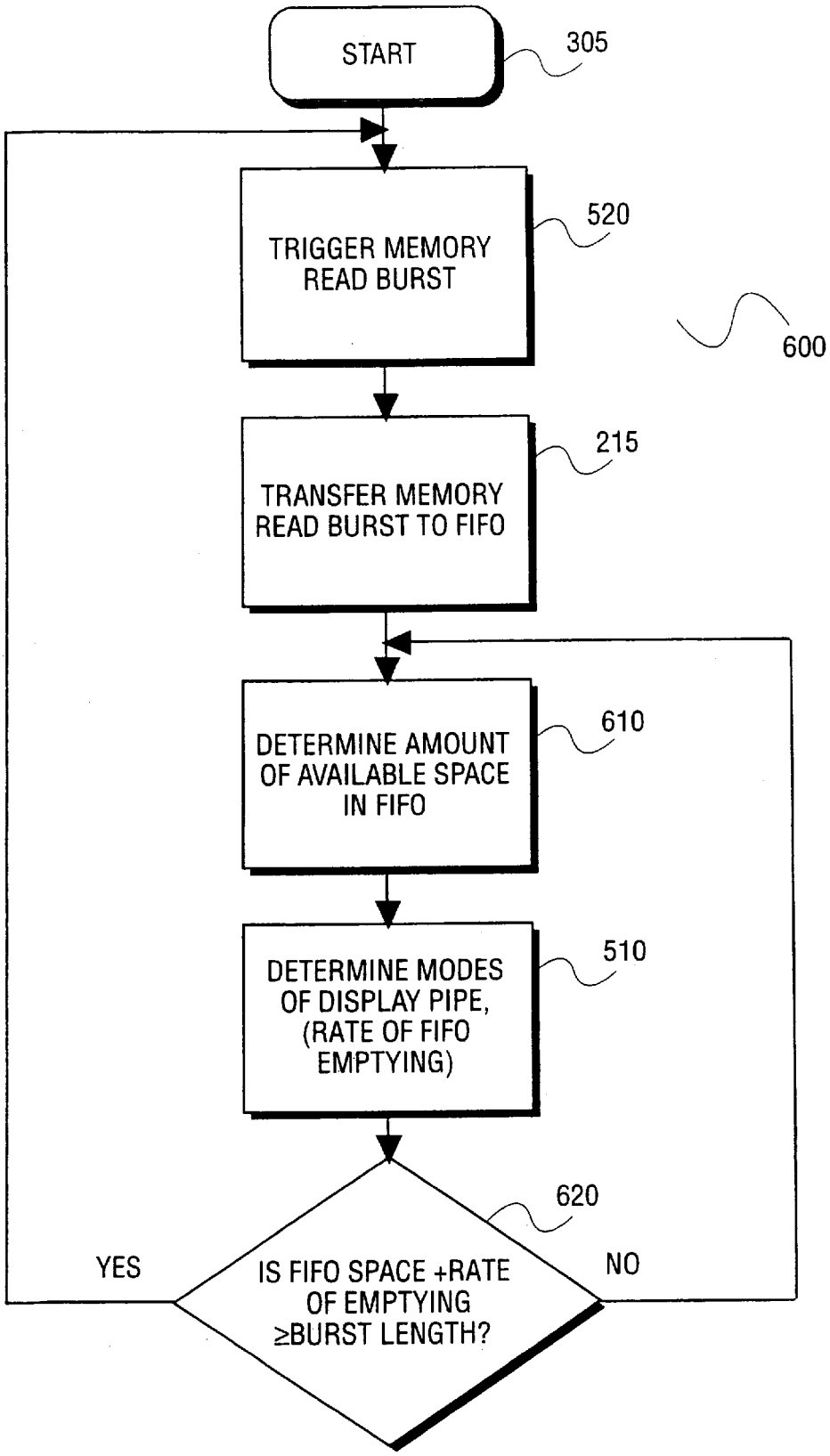
FIG. 6 is a flowchart showing the overlay data loading process with burst length trigger detection logic used by a pixel processing engine according to one embodiment of the present invention.

FIG. 6 shows overlay data loading process 600 used by pixel processing engine 500 in FIG. 5. Process 600 begins at start state 305. Proceeding to state 520, a memory read burst is triggered. Next, the memory read burst is transferred to line-FIFO 215. Block 610 determines the amount of available space in line-FIFO 215. Block 510 then determines the modes of the display pipe, i.e., rate of FIFO emptying which, is based upon processing taking palace in $V_{zoom}$ 210, Line-FIFO 215, $H_{zoom}$ 225, and pixel color conversion and adjustment 230. Block 620 then determines if the available space in line-FIFO 215 added to the rate of emptying line-FIFO 215 multiplied by the amount of memory latency is greater than or equal to the burst length. If block 610 determines that the available space in line-FIFO 215 added to the rate of emptying line-FIFO 215 multiplied by the amount of memory latency is greater than or equal to the burst length, then block 620 branches back to trigger memory read burst 520. If block 610 determines that the available space in line-FIFO 215 added to the rate of emptying line-FIFO 215 multiplied by the amount of memory latency is not greater than or equal to the burst length, then block 620 branches back to bock 610 to determine the amount of space that is available in line-FIFO 215. Note that the emptying of line-FIFO 215 and the display of data on a display is occurring simultaneously. Therefore, overlay data loading process 600 predicts when there is enough available room in line-FIFO 215 to handle a next memory read burst. Thus, a trigger to memory burst read 520 can be asserted "early" based on the mode and amount of data in ther line-FIFO 215.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A method comprising:

triggering a memory read burst;

transferring the memory read burst into a buffer;

reading video data for a current video line from the buffer;

determining available space in the buffer;

determining a mode of a display pipe; and predicting when the next triggering of a memory read burst can be made based on data size of a next memory read burst and availability of storage space in said buffer, upon issuance of said next memory read burst, to store all of said next memory read burst data while reading video data for said current video line, wherein memory read burst data size and video data size for the current video line are variable, and the issuance of said next memory read burst is withheld until storage space in said buffer is available to store all of said next memory read burst data.

2. The method of claim 1, wherein the buffer is a line-FIFO.

3. The method of claim 2, wherein determining the mode of a display pipe is based on a rate of emptying the line-FIFO.

4. The method of claim 1, further comprising processing the current video line data for display.

5. The method of claim 4, further comprising displaying the processed video line data.

6. The method of claim 5, further comprising creating a video overlay from the processed video line data.

7. The method of claim 1, further comprising positioning the pixel data on an active display to create a video overlay.

8. A method of processing video overlay data comprising:

reading video data for a current video line from a buffer;

determining when a next video line can be read from the buffer; and loading data for the next video line into the buffer while said current video line is being read from said buffer upon determining availability of memory space in said buffer upon issuance of a next burst read to store all the data for said next burst read, wherein memory burst read data size and video data size for the current video line are variable, and the issuance of said next burst read is withheld until storage space in said buffer is available to store all of said data for said next burst read.

9. The method of claim 8, further comprising processing the current video line data for display.

10. The method of claim 9, further comprising displaying the processed video line data.

11. The method of claim 8, further comprising loading data for the next video line to replace data for the current video line in the buffer.

12. The method of claim 8, further comprising creating a video overlay from the processed video line data.

13. The method of claim 8, further comprising positioning the pixel data on an active display to create a video overlay.

14. A overlay display processor comprising:

a buffer having a plurality of memory locations, the memory adapted to provide data to a display; and a burst length trigger detector coupled to the buffer, wherein the buffer begins to read data for a next video data line when the burst length trigger detector determines the buffer is capable of storing all of the next video data line in said buffer, wherein the next video data size is variable and the next video data line is provided to the buffer while current video data is read from the buffer, and reading of data for the next video data line is withheld until said buffer is capable of storing all of said data for said next video data line.

15. The processor of claim 14, further comprising a graphic memory coupled to the buffer which provides the video pixel data to the buffer.

16. The processor of claim 14, wherein the buffer provides data to the display for a current video line.

17. A overlay display system comprising:

video memory which stores video data;

an overlay processing engine having:

a buffer which receives the video data front the memory;

video processing circuitry coupled to a burst length trigger detector, wherein the video processing circuitry prepares the video data in the buffer to be displayed; and a display coupled to the video processing circuitry which receives the processed data from the overlay processing engine, wherein the buffer begins to read data for a next video data line when the burst length trigger detector determines the buffer is capable of storing all of the amount of data for a next video data line, wherein the video data size is variable and the next video data line is stored to the buffer while current video data is read from the buffer, and reading of data for the next video data line is withheld until said buffer is capable of storing all of the amount of data for said next video data line.

18. The system of claim 17, wherein the overlay processing engine provides data to the display to create a video overlay.

19. The system of claim 17, wherein the video processing circuitry includes pixel color conversion and adjustment.

20. A program storage device readable by a machine comprising instructions that cause the machine to:

read pixel data for a current video line from a buffer;

determine when the buffer is capable of storing a next reading of pixel data; and load data for a next video line into the buffer upon determining that the buffer is capable of storing one of all of and none of the next read pixel data, wherein the current read pixel data size and the next read pixel data size are variable and the current video line data is read from the buffer while the next video line data is stored to the buffer.

21. The program storage device of claim 20, wherein the instructions further cause the machine to predict when data can be loaded into the buffer before the buffer is capable of storing the next read pixel data.

22. The program storage device of claim 21, wherein the instructions causing the machine to predict when data can be loaded into the buffer before the buffer is capable of storing the next read pixel data are based on a mode of a display pipe.

* * * * *